US008220187B2

(12) United States Patent
Rosen

(10) Patent No.: US 8,220,187 B2
(45) Date of Patent: Jul. 17, 2012

(54) BEVERAGE BOTTLE IDENTIFICATION SYSTEM

(75) Inventor: Matthew Lee Rosen, Chicago, IL (US)

(73) Assignee: BeerTAG LLC, Chicago, IL (US)

( * ) Notice: Subject to any disclaimer, the term of this patent is extended or adjusted under 35 U.S.C. 154(b) by 0 days.

(21) Appl. No.: 13/009,754

(22) Filed: Jan. 19, 2011

(65) Prior Publication Data

US 2011/0173852 A1 Jul. 21, 2011

Related U.S. Application Data

(60) Provisional application No. 61/296,175, filed on Jan. 19, 2010.

(51) Int. Cl.
*G09F 3/00* (2006.01)

(52) U.S. Cl. ..... 40/310

(58) Field of Classification Search ..... 40/310, 40/657

See application file for complete search history.

(56) References Cited

U.S. PATENT DOCUMENTS

| | | | | |
|---|---|---|---|---|
| 1,793,348 | A * | 2/1931 | Rusling | 40/310 |
| 1,829,915 | A * | 11/1931 | Wasser | 40/310 |
| 1,899,284 | A * | 2/1933 | Manhard | 40/310 |
| 1,999,011 | A * | 4/1935 | Wasser | 40/310 |
| 3,382,779 | A * | 5/1968 | Andrew | 493/276 |
| 2005/0235532 | A1 * | 10/2005 | Eberl et al. | 40/310 |
| 2008/0047178 | A1 * | 2/2008 | Marszalek | 40/310 |

* cited by examiner

*Primary Examiner* — Gary Hoge
(74) *Attorney, Agent, or Firm* — Richards Patent Law P.C.

(57) ABSTRACT

A beverage bottle identification system includes a set of identification tags, wherein each identification tag is formed in a hollow approximately conical shape configured to be secured along the neck of an associated beverage bottle, further wherein each of the identification tags in the set is visually distinguishable from the other identification tags in the set. In addition, the system may include a display stand including a plurality of identification tag holders adapted to store one or more sets of identification tags. At least one of the identification tag holders may include a portion shaped approximately like the neck of the associated beverage bottle.

17 Claims, 2 Drawing Sheets

BEVERAGE BOTTLE IDENTIFICATION SYSTEM

CROSS-REFERENCE TO RELATED APPLICATIONS

This application claims the benefit of U.S. Provisional Application No. 61/296,175, filed on Jan. 19, 2010, the entirety of which is incorporated herein by reference.

BACKGROUND OF THE INVENTION

The present subject matter relates generally to a beverage bottle identification system. More specifically, the present invention relates to a beverage bottle identification system utilizing an identification collar for mating with a bottle neck.

In a busy social setting, people drinking the same brand of beverage often confuse which bottle, cup, or can they were drinking, after placing it down momentarily near or next to another beverage of the same kind. Accidentally picking up and drinking another person's beverage is not only impolite, but also poses a risk of exposure to any contagious medical conditions. Many known systems exist that attempt to solve the problem of beverage identification. However, none of the known systems have made any real impact in the marketplace.

One of the limitations of the known systems is that they are typically not readily available in commercial establishments where they would be best utilized. In order to encourage a commercial establishment to provide a beverage bottle identification system for its customers, it may be beneficial to provide a cost effective identification system that functions as an advertising medium. As an advertising medium, the system may be provided to the commercial establishment by advertisers for use by the customers.

Accordingly, a need exists for a beverage bottle identification system that is easy to use, cost effective and provides an advertising medium.

BRIEF SUMMARY OF THE INVENTION

The beverage bottle identification system disclosed herein provides an easy to use, cost effective identification system that also functions as an advertising medium. The beverage bottle identification system disclosed herein includes a plurality of identification tags associated with a display stand. As shown, the display stand incorporates a base into which a number of identification tag holders are provided.

The present subject matter aims to provide a solution in three distinct fields; property identification, product personalization, and advertising media.

With respect to property identification; tags, charms, engravings, adhesive labels and other markings are used to visually identify the ownership of personal possessions (including luggage, keys, portable electronics, and many other consumer goods). The beverage bottle identification system disclosed herein provides a system wherein users may identify their personal beverage with an identification tag.

A current ongoing trend in consumer goods is personalization, as consumers are given style and design options by product manufacturers to personally customize a wide range of products. With respect to product personalization, the beverage bottle identification system disclosed herein provides consumers the ability to customize their beverage bottle by selecting a customized identification tag.

In commercial settings where bottled beverages are being served, advertising can be found in the form of napkins, drink coasters, bar mats, and other promotional items. The beverage bottle identification system disclosed herein provides additional targeted advertising and marketing space.

The present subject matter provides benefits to waiting staff in commercial establishments. For example, the beverage bottle identification system may help the bar and waiting staff organize drink orders, making service more efficient and reducing order and billing errors. Additionally, in a controlled environment, billing may be verified by the number of identification tags an individual has used (e.g., at the end of the night, the customer who was using the red identification tag had five drinks and the customer who was using the blue identification tag had seven drinks).

In one example, a beverage bottle identification system includes a set of identification tags, wherein each identification tag is formed in a hollow approximately conical shape configured to be secured along the neck of an associated beverage bottle, further wherein each of the identification tags in the set is visually distinguishable from the other identification tags in the set. In addition, the system may include a display stand including a plurality of identification tag holders adapted to store one or more sets of identification tags. At least one of the identification tag holders may include a portion shaped approximately like the neck of the associated beverage bottle.

In one example, the identification tags are each formed as a one-piece construction formed from an elastomeric material. In addition, the identification tags may include visual advertising. In some instances the visual advertising may differentiate the identification tags from each other. In other examples, the identifications tags include the same visual advertising and each of the identifications tags further includes another visually distinguishing characteristic. For example, the colors of the identification tags may be the visually distinguishing characteristic.

A method of making an identification tag may include the steps of: providing a paper blank; coating the paper blank with a thermoplastic polymer coating; heating the thermoplastic polymer coating; forming the paper blank into an approximately conical form; and cooling the thermoplastic polymer coating to form a unitary conical identification tag configured to be secured along the neck of a beverage bottle. For example, a polyethylene coating may be used and it may be heated ultrasonically. In addition, the steps of the process may be otherwise ordered, such as, for example, the thermoplastic polymer coating may be heated prior to coating the paper blank. Additionally, the final shape of the identification tag may be formed prior to applying the thermoplastic polymer coating.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
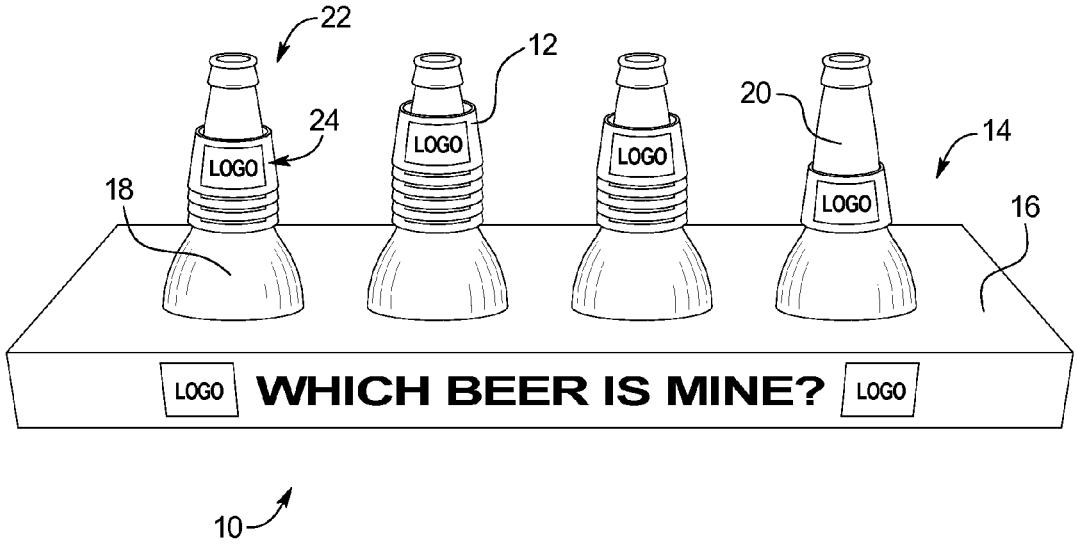
FIG. 1 is a perspective view of a beverage bottle identification system.

The beverage bottle identification system 10 shown in FIG. 1 includes a plurality of identification tags 12 associated with a display stand 14. As shown, the display stand 14 incorporates a base 16 into which a number of identification tag holders 18 are provided.

In the example of the beverage bottle identification system 10 shown in FIG. 1, the identification tags 12 are stackable tags adapted to fit over the neck 20 of a standard twelve fluid ounce beverage bottle 22. An isolated identification tag 12 is shown in FIG. 2, as described in further detail as follows.

Figure 2:
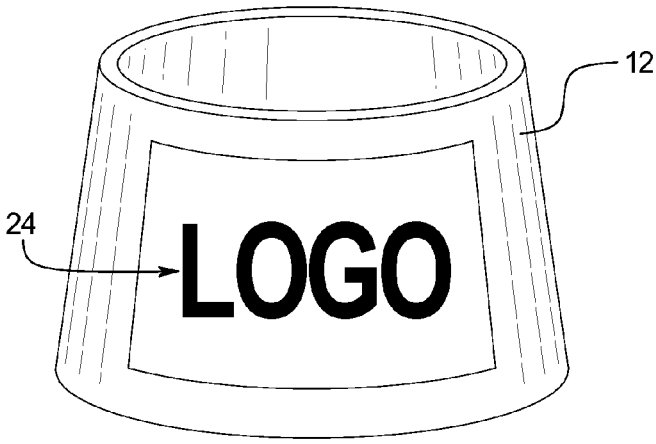
FIG. 2 is a perspective view of a beverage bottle identification tag.

The identification tag 12 shown in FIG. 2 is formed from an elastomeric material (such as, for example, rubber), which enables the identification tag 12 to easily adapt to the neck 20 of the bottle 22 when placed thereon to ensure a tight fit. However, it is contemplated that the identification tag 12 may be formed from any number of materials, including paper pulp, silicone, plastic, vinyl, etc. The various materials used may promote varied characteristics of the identification tag 12. For example, paper identification tags 12 may be disposable, while identification tags 12 made from plastic, rubber, vinyl, silicone, etc. may be water-resistant and reusable.

In another contemplated example, the identification tags 12 may be formed from a thermoplastic polymer coated paper, such as, for example, a polyethylene coated paper. In such examples, a paper blank may be cut into a generally arc shaped form, printed with appropriate visually identifiable characteristics, coated with polyethylene, formed into the approximately conical shape and then ultrasonically heated to form the identification tag 12 as a unitary piece.

Accordingly, a method of making an identification tag may include the steps of: providing a paper blank; coating the paper blank with a thermoplastic polymer coating; heating the thermoplastic polymer coating; forming the paper blank into an approximately conical form; and cooling the thermoplastic polymer coating to form a unitary conical identification tag configured to be secured along the neck of a beverage bottle. For example, a polyethylene coating may be used and it may be heated ultrasonically. In addition, the steps of the process may be otherwise ordered, such as, for example, the thermoplastic polymer coating may be heated prior to coating the paper blank. Additionally, the final shape of the identification tag may be formed prior to applying the thermoplastic polymer coating.

The identification tags 12 are designed to be provided in a plurality of colors and/or designs such that the color and/or design of the identification tag 12 may be used as an identification attribute. Any number of colors and/or designs may be used to create distinctly identifiable visual attributes. For example, various combinations of textures, logos, colors and other visual features may be used to create a set of identification tag 12 wherein each of the identification tags 12 in the set may be easily visually distinguished from the others.

As further shown in the example provided in FIG. 2, the identification tags 12 provide a space for branding and advertising along the outer surface 24. For example, the outer surface 24 of the identification tags 12 may be branded with a logo or other identification information. Providing an easily branded surface promotes the likelihood that the identification tags 12 will be provided to commercial establishments by advertisers. Regardless of whether the outer surface 24 is used for branding and/or advertising, the outer surface 24 may be the primary portion of the identification tag 12 used to differentiate one identification tag 12 from the next in a given set of identification tags 12. However, it is contemplated that other characteristics may be used to distinguish between the identification tags 12. For example, the profile of the top edge 26 or bottom edge 28 of the identification tag 12 may be distinctly shaped to provide a distinguishing feature.

The identification tags 12 shown are approximately conical shaped, which allow the identification tags 12 to be stacked for shipment, packing and display on the display stand 14, as shown in FIG. 1. The hollow conical shape of the identification tag 12 also enables the identification tag 12 to easily drop over the neck 20 of a bottle 22 to fit snuggly in place as shown in FIG. 3*a*. Depending on the material used, the elasticity of the identification tag 12 may further help to maintain the identification tag 12 snuggly in place on the neck 20 of a bottle 22. For example, in one embodiment using an elastomeric material, an identification tag 12 may be provided that is adaptable to both twelve and sixteen ounce glass and plastic bottles. However, it is contemplated that the identification tag 12 may be provided in various sizes and adapted to fit to any size bottle 22 or bottles 22.

Figure 3B:
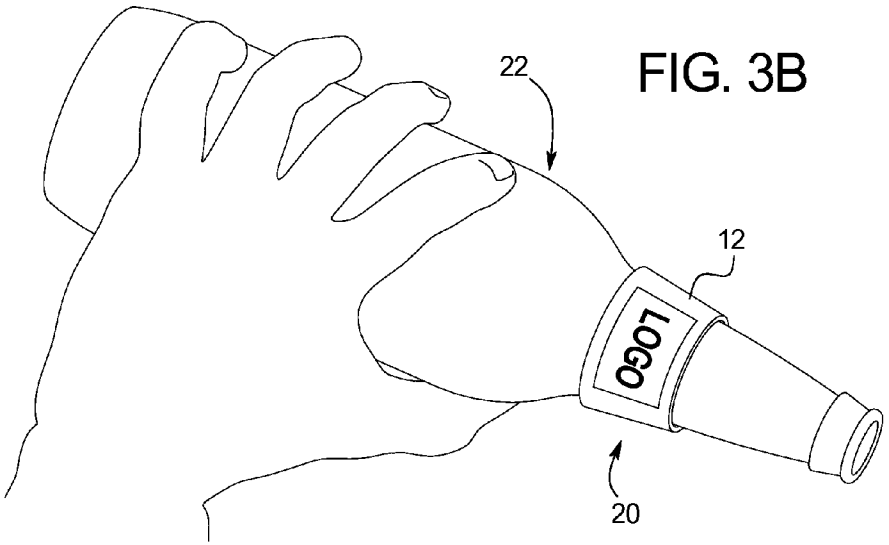
FIGS. 3*a*-3*b* are perspective views of the beverage bottle identification tag in use.
Figure 3A:
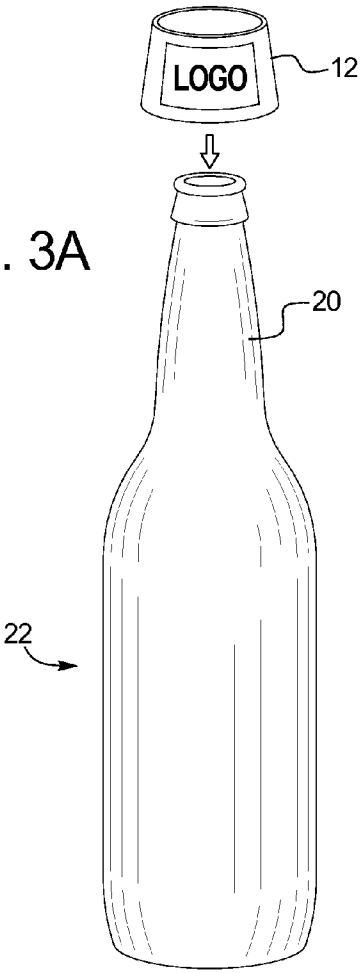

As further shown in FIG. 3*b*, the snug fit of the identification tag 12 keeps the identification tag 12 firmly in place along the neck 20 of the bottle 22 and helps to prevent the identification tag 12 from sliding towards the drinker's mouth when the beverage is being consumed.

The base 16 shown in FIG. 1 is a plastic bar caddy onto which replica bottle tops are provided to function as identification tag holders 18 to organize and store the identification tags 12. In use, the base 16 may be provided, for example, in a commercial bar and/or restaurant environment near the coasters, straws, napkins, bar accessories, etc. In the example shown in FIG. 1, by incorporating replica bottle portions as the identification tag holders 18, the base 16 functions as a demonstration of how to use the identification tags 12.

The identification tag holders 18 shown in FIG. 1 resemble the upper portion of beverage bottles 22. However, it is understood that the identification tag holders 18 may be alternately shaped. For example, the identification tag holders 18 may be cylindrical or conical posts upon which the identification tags 12 may rest. Both the identification tags 12 and the identification tag holders 18 may be adapted to various shapes and configurations as needed to provide advertising space and to meet the functional goals expressed and described herein.

The base 16 and the identification tag holders 18 shown in FIG. 1 are formed from plastic. However, it is understood that either and/or both elements may be formed from numerous materials, such as metals, plastics, woods, etc. It is also contemplated that the base 16 and the identification tag holders 18 can be made from the same material or different materials.

In the example shown in FIG. 1, the base 16 includes four identification tag holders 18. However, it is contemplated that any number of identification tag holders 18 may be provided on a given base 16. For example, it is contemplated that larger versions of the base 16, for example, may include six identification tag holders 18.

The base 16 provides another medium for visual advertising, branding and logo placement. For example, the front, sides and top of the base 16 provide surfaces upon which advertising, branding and logo placement may be made. Further, the identification tag holders 18 may be vehicles for advertising, branding and logo placement.

In use, the beverage bottle identification system 10 provides personal identification of a beverage bottle 22, simply by selecting an identification tag 12 from a display stand 14 and placing the identification tag 12 over the neck 20 of the beverage bottle 22, where it drops to fit snugly in place. When not in use, the identification tags 12 are stacked by color and/or design onto their display base 16 for storage on counter-top surfaces at bars, taverns, lounges, night clubs, beer gardens, restaurants, and other business establishments where bottled beverages are served. The design of the display base 16 and identification tag holders 18 mimic the shape of a group of beverage bottles 22, to guide the consumer on how to use the identification tag 12. Both the identification tag 12 and the display base 16 provide advertising space.

It is understood that the beverage bottle identification system 10 described herein may be adapted in numerous ways. For example, the identification tag 12 may be personalized and provided with a key chain attachment such that an individual may more easily carry around his or her own identification tag 12. Such a version may preferably be made from a durable material.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A beverage bottle identification system comprising:

a set of identification tags, wherein each identification tag is formed in a hollow approximately conical shape configured to be secured along the neck of an associated beverage bottle, further wherein each of the identification tags in the set is visually distinguishable from the other identification tags in the set; and a display stand including a plurality of identification tag holders adapted to store one or more sets of identification tags.

2. The system of claim 1 wherein at least one of the identification tag holders includes a portion shaped approximately like the neck of the associated beverage bottle.

3. The system of claim 2 wherein the associated beverage bottle is a standard twelve ounce glass bottle.

4. The system of claim 1 wherein the identification tags are each formed as a one-piece construction.

5. The system of claim 4 wherein the identification tags are each formed from an elastomeric material.

6. The system of claim 1 wherein the identification tags include visual advertising.

7. The system of claim 6 wherein each of the identifications tags includes the same visual advertising and each of the identifications tags further includes a visually distinguishing characteristic.

8. The system of claim 7 wherein the visually distinguishing characteristic is the color of the identifications tag.

9. The system of claim 6 wherein each of the identification tags in the set includes distinct visual advertising.

10. The system of claim 1 wherein the identification tags are each formed from a polyethylene coated paper.

11. A method of making an identification tag comprising the steps of:

providing a paper blank;

coating the paper blank with a thermoplastic polymer coating;

heating the thermoplastic polymer coating;

forming the paper blank into an approximately conical form; and cooling the thermoplastic polymer coating to form a unitary conical identification tag configured to be secured along the neck of a beverage bottle.

12. The method of claim 11 wherein the step of heating the thermoplastic polymer coating is accomplished via ultrasonic heating.

13. The method of claim 11 wherein the step of heating the thermoplastic polymer coating occurs after the step of coating the paper blank.

14. The method of claim 11 wherein the step of heating the thermoplastic polymer coating occurs before the step of coating the paper blank.

15. The method of claim 11 wherein the step of forming the paper blank into an approximately conical form occurs after the step of coating the paper blank with a thermoplastic polymer coating.

16. The method of claim 11 wherein the step of forming the paper blank into an approximately conical form occurs before the step of coating the paper blank with a thermoplastic polymer coating.

17. The method of claim 11 wherein the thermoplastic polymer is polyethylene.

* * * * *